US010617937B1

(12) United States Patent
Murphy

(10) Patent No.: US 10,617,937 B1
(45) Date of Patent: Apr. 14, 2020

(54) CARD GAME

(71) Applicant: Debba L. Murphy, Hampton, GA (US)

(72) Inventor: Debba L. Murphy, Hampton, GA (US)

( * ) Notice: Subject to any disclaimer, the term of this patent is extended or adjusted under 35 U.S.C. 154(b) by 0 days.

(21) Appl. No.: 15/925,960

(22) Filed: Mar. 20, 2018

(51) Int. Cl.

| | |
|---|---|
| ***A63F 1/00*** | (2006.01) |
| ***A63F 11/00*** | (2006.01) |
| *A63F 1/02* | (2006.01) |
| *A63F 1/04* | (2006.01) |

(52) U.S. Cl.
CPC ..... *A63F 1/00* (2013.01); *A63F 11/0074* (2013.01); *A63F 1/02* (2013.01); *A63F 1/04* (2013.01); *A63F 2001/001* (2013.01); *A63F 2001/027* (2013.01); *A63F 2001/0416* (2013.01); *A63F 2011/0086* (2013.01)

(58) Field of Classification Search
CPC ..... A63F 2001/001; A63F 2001/0416; A63F 2001/027; A63F 1/00; A63F 1/02; A63F 1/04
USPC ..... 273/292, 303–307; D21/378, 379, 376
See application file for complete search history.

(56) References Cited

U.S. PATENT DOCUMENTS

| | | | | | |
|---|---|---|---|---|---|
| 1,011,610 | A | * | 12/1911 | Gaskill | A63F 1/02 273/305 |
| D45,449 | S | * | 3/1914 | Down | 273/303 |
| D45,547 | S | * | 3/1914 | Down | D21/379 |
| D269,447 | S | * | 6/1983 | Raheb | 273/303 |
| 4,807,885 | A | | 2/1989 | Chamblee | |
| 5,451,062 | A | | 9/1995 | Malone | |
| 5,788,241 | A | * | 8/1998 | Ung | A63F 9/20 273/292 |
| 7,469,900 | B2 | | 12/2008 | Patelidas | |
| 7,503,564 | B2 | | 3/2009 | Weigl | |
| 8,733,760 | B1 | | 5/2014 | Fontana | |
| 2009/0085292 | A1 | | 4/2009 | Patelidas | |

FOREIGN PATENT DOCUMENTS

WO 2006019518 A 2/2006

* cited by examiner

*Primary Examiner* — Benjamin Layno

(57) ABSTRACT

The six person card game is a plain trick card game played with a customized deck of 78 playing cards. The six person card game closely follows the play of the card game called Spades. Similarities with the game of Spades include: 1) the dealing of all cards to all players; 2) the order of trick play; 3) the protocols for claiming a trick; 4) the use of the spades as the trump suit; and, 5) the protocols regarding bidding and scoring specific to game of Spades. Dissimilarities with the game of Spades include: 1) a requirement for six players; 2) a hand has 13 tricks; 3) the use of the 78 card deck; 4) variation of cards contained within each suit; 5) differences exist between the face values of the 78 card deck; and, 6 differences in the order of rank within a given suit.

10 Claims, 4 Drawing Sheets

CARD GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of health and amusement, more specifically, a plain trick card game related to the game of bridge.

The game of Spades is a popular game in the United States that is experiencing a growing popularity worldwide. The game of Spades is a plain trick playing card game that is played using a traditional deck of 52 playing cards. The game of Spades is a four person game. Within a game of Spades, the decreasing order of rank of cards within each suit is ace, king, queen, jack, ten, nine, eight, seven, six, five, four, three, and two. The suit of spades is a trump suit.

To play a hand of Spades, the full deck of cards is dealt to the four players such that each player has the same number of cards. This provides for 13 tricks in each hand of play. The order of play for each trick is a follows.

A lead player is selected from the group consisting of: 1) the player to the left of the (fourth) player who dealt the deck, and, 2) the player who won the previous trick. The lead player presents a card face up to start the trick.

The second player to play sits to the left of the lead player. The second player presents a card face up for their turn. The second player is constrained to play a card from the same suit as played by the lead player if the second player has such a card. If the second player does not have such a card, the second player may play any card from the cards the second player has.

The third player to play sits to the left of the second player. The third player presents a card face up for their turn. The third player is constrained to play a card from the same suit as played by the lead player if the third player has such a card. If the third player does not have such a card, the third player may play any card from the cards the third player has.

The fourth player to play sits to the left of the third player. The fourth player presents a card face up for their turn. The fourth player is constrained to play a card from the same suit as played by the lead player if the fourth player has such a card. If the fourth player does not have such a card, the fourth player may play any card from the cards the fourth player has.

Once all players have presented a card, the trick is awarded on the following basis: 1) if no trump card has been presented, the player presenting the highest ranked card of the suit played by the lead player wins the trick (this player may be the lead player); 2) if a single trump card has been presented, the player who presented the trump card wins the trick; or 3) if multiple trump cards have been presented, the player who presented the highest ranked card of the trump suit wins the trick.

The winner of the trick is then selected as the new lead player and the next trick is initiated until all cards from the deck have been played. At that point, the lead player of the first trick of the current hand becomes the fourth player of the first trick of the subsequent hand.

Spades is a cumulative scoring game that is played in a partnership format. Two partnerships of two players compete against each other for scoring purposes. At the beginning of the game, each player declares the number of tricks the individual player will take. The number from each partner is added to set a goal for the number of tricks to be reached by each partnership. Should a partnership reach their goal, the partnership is awarded points to add to their cumulative goal. The number of points added is a function of the number of total tricks bid and the number total tricks won. Should a partnership fail to reach their goal, the partnership forfeits points from their cumulative goal. The number of points forfeited is a function of the number of total tricks bid and the number total tricks won. A partnership is declared the winning partnership once their cumulative score exceeds a previously determined threshold.

Much of the terminology used in this background is described in greater detail elsewhere in this disclosure.

One of the limitations of Spades is that participation in the game is limited to two partnerships. While multiple games of Spades may be played when the number of available partnerships is even, the appropriateness of playing Spades when the number of appropriate partnerships is odd can be problematic. Clearly, a method of playing Spades involving three partnerships would be of benefit.

SUMMARY OF INVENTION

This disclosure addresses the above limitation of the game of Spades.

The six person card game is a plain trick card game played with a customized deck of playing cards. The six person card game is played with six players. The six person card game closely follows the play of the card game called Spades which is described in detail elsewhere in this disclosure. Specific similarities with the game of Spades include, but are not limited to: 1) the dealing of all cards to all players; 2) the order of trick play; 3) the protocols for claiming a trick; 4) the use of the spades as the trump suit; and, 5) the protocols regarding bidding and scoring specific to game of Spades. Specific dissimilarities with the game of Spades include, but are not limited to: 1) the requirement for six players instead of four players; 2) a hand of the six person card game has 13 tricks instead of the traditional 13 tricks; 3) the use of the 78 card deck instead of a traditional playing card deck of 52 cards; 4) within the 78 card deck the number of cards contained within each suit varies by suit; 5) differences exist between the face values of the 78 card deck and the face values of a traditional 52 card deck; and, 6) the differences in the face values described in 5) result in differences in the order of rank within a given suit.

These together with additional objects, features and advantages of the six person card game will be readily apparent to those of ordinary skill in the art upon reading the following detailed description of the presently preferred, but nonetheless illustrative, embodiments when taken in conjunction with the accompanying drawings.

In this respect, before explaining the current embodiments of the six person card game in detail, it is to be understood that the six person card game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the six person card game.

It is therefore important that the claims be regarded as including such equivalent construction insofar as they do not depart from the spirit and scope of the six person card game. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
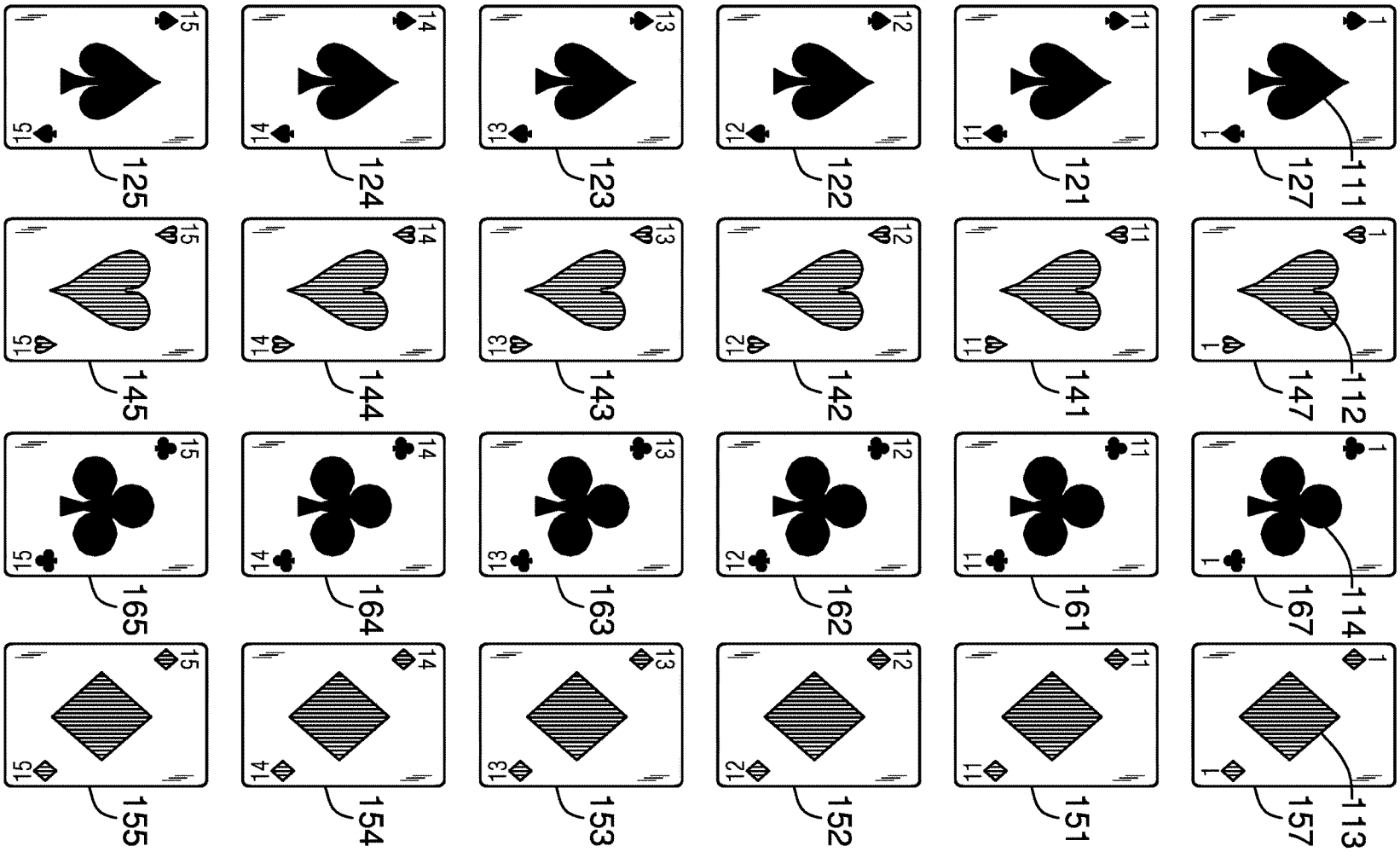
FIG. 1 is a detail view of an embodiment of the disclosure.
Figure 2:
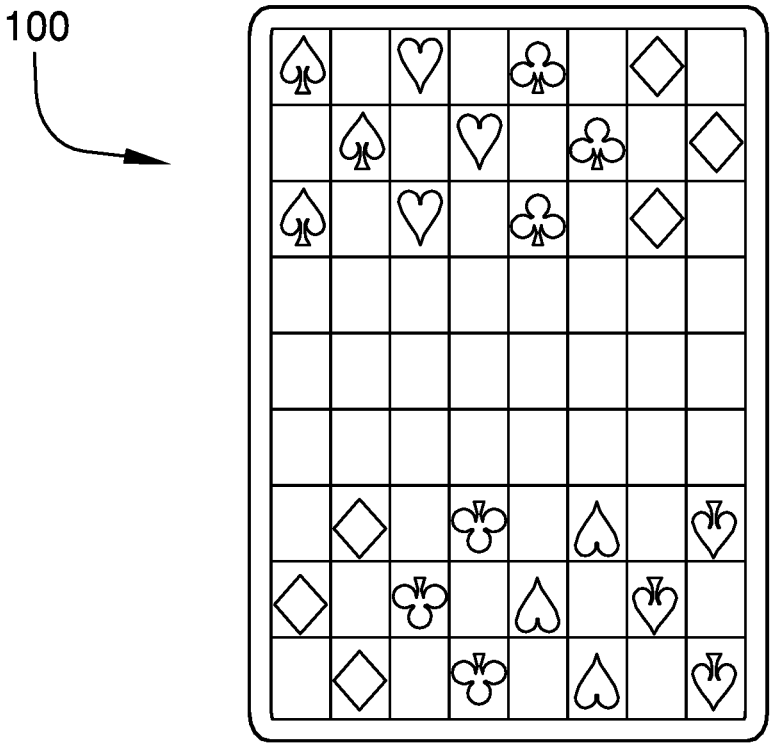
FIG. 2 is a rear view of an embodiment of the disclosure.
Figure 3:
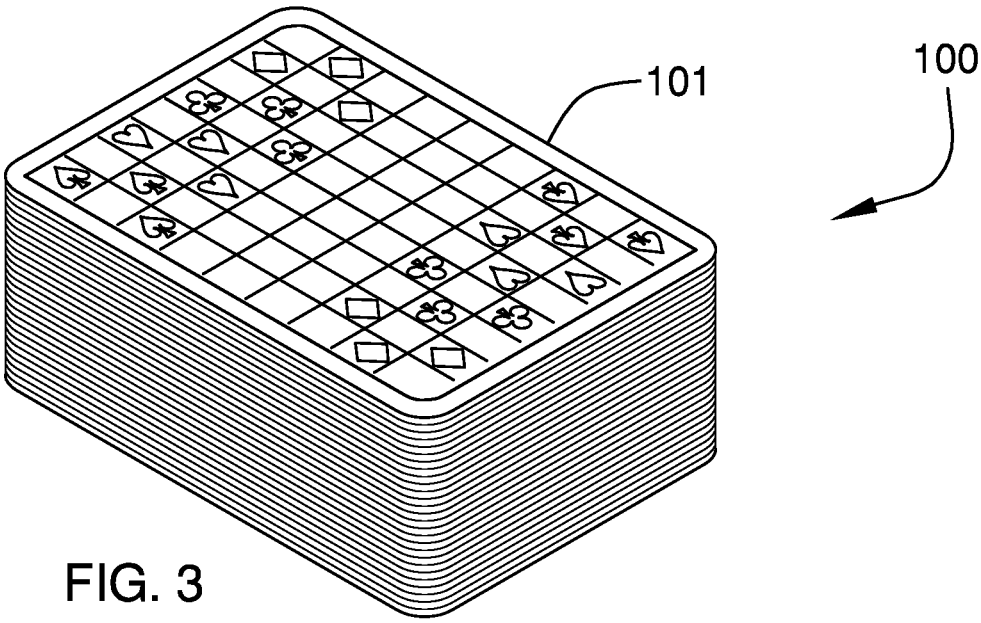
FIG. 3 is a perspective view of an embodiment of the disclosure.
Figure 4:
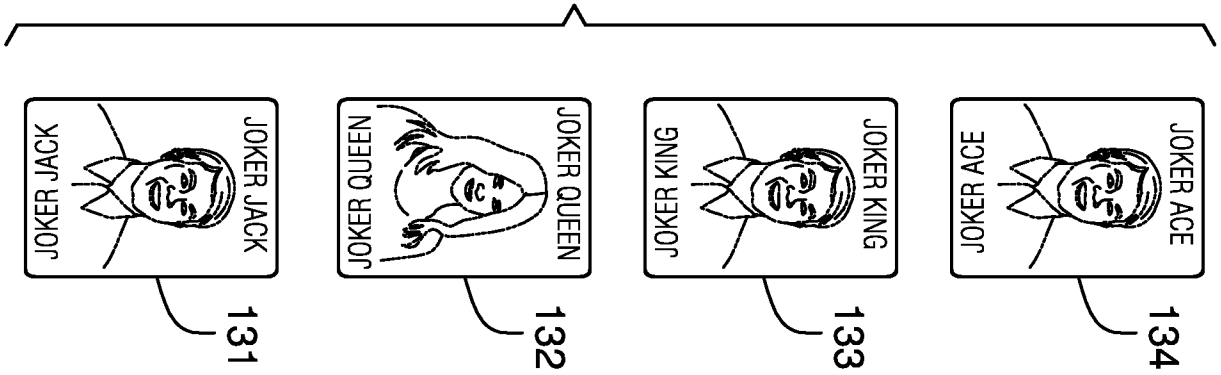
FIG. 4 is a detail view of an embodiment of the disclosure.
Figure 5:
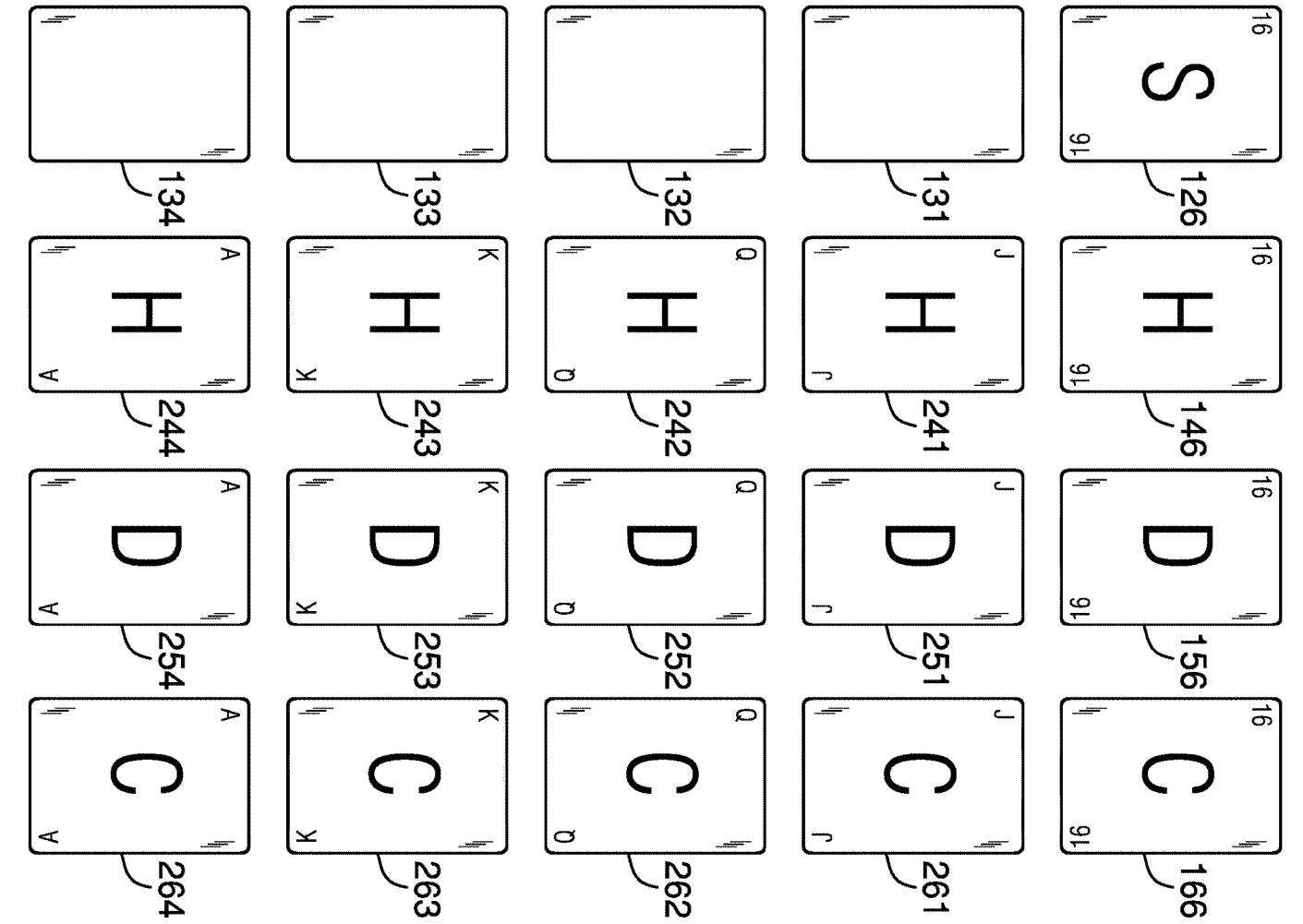
FIG. 5 is a detail view of an embodiment of the disclosure.

Detailed reference will now be made to one or more potential embodiments of the disclosure, which are illustrated in FIGS. 1 through 5.

The six person card game 100 (hereinafter invention) is a plain trick card game played with a customized deck of playing cards. The invention 100 comprises a deck of 78 playing cards 101. The invention 100 is played with six players. The invention 100 closely follows the play of the card game called Spades which is described in detail elsewhere in this disclosure. Specific similarities with the game of Spades include, but are not limited to: 1) the dealing of all cards to all players; 2) the order of trick play; 3) the protocols for claiming a trick; 4) the use of the spades 111 as the trump suit; and, 5) the protocols regarding bidding and scoring specific to game of Spades. Specific dissimilarities with the game of Spades include, but are not limited to: 1) the requirement for six players instead of four players; 2) a hand of the invention 100 has 13 tricks instead of the traditional 13 tricks; 3) the use of the 78 card deck 101 instead of a traditional playing card deck of 52 cards; 4) within the 78 card deck 101 the number of cards contained within each suit varies by suit; 5) differences exist between the face values of the 78 card deck 101 and the face values of a traditional 52 card deck; and, 6) the differences in the face values described in 5) result in differences in the order of rank within a given suit.

The invention 100 comprises a 78 card deck 101. Ideally, the invention 100 has an 80 card deck, but the 2 Hearts and the 2 diamonds are removed, leaving with the 78 card deck 101. Each suit is equally divided with 20 cards. Each card contained within the 78 card deck 101 has a unique image printed on the face of the card. Each card contained within 78 card deck 101 is assigned to a suit selected from the group consisting of a spade 111 suit, a heart 112 suit, a diamond 113 suit, and a club 114 suit. Each card contained within 78 card deck 101 is only assigned to one of the group of suits. There are 20 cards selected from the 78 card deck 101 assigned to the spade 111 suit. There are 19 cards selected from the 78 card deck 101 assigned to the heart 112 suit. There are 19 cards selected from the 78 card deck 101 assigned to the diamond 113 suit. There are 20 cards selected from the 78 card deck 101 assigned to the club 114 suit.

The cards contained within the suit of spades 111 comprises a joker ace 134, a joker king 133, a joker queen 132, a joker jack 131, a 16 of spades 126, a 15 of spades 125, a 14 of spades 124, a 13 of spades 123, a 12 of spades 122, an 11 of spades 121, a 10 of spades, a 9 of spades, an 8 of spades, a 7 of spades, a 6 of spades, a 5 of spades, a 4 of spades, a 3 of spades, a 2 of spades, and a 1 of spades 127.

The joker ace 134, the joker king 133, the joker queen 132, and the joker jack 131 are customizable cards. During the manufacture of the 78 card deck 101 it is anticipated that: 1) a first customized image is printed the joker jack 131; a second customized image is printed on the joker queen 132; a third customized image is printed on the joker king 133; and a fourth customized image is printed on the joker ace 134.

The cards contained within the suit of hearts 112 comprises a ace of hearts 244, a king of hearts 243, a queen of hearts 242, a jack of hearts 241, a 16 of hearts 146, a 15 of hearts 145, a 14 of hearts 144, a 13 of hearts 143, a 12 of hearts 142, an 11 of hearts 141, a 10 of hearts, a 9 of hearts, an 8 of hearts, a 7 of hearts, a 6 of hearts, a 5 of hearts, a 4 of hearts, a 3 of hearts, and a 1 of hearts 147.

The cards contained within the suit of diamonds 113 comprises a ace of diamonds 254, a king of diamonds 253, a queen of diamonds 252, a jack of diamonds 251, a 16 of diamonds 156, a 15 of diamonds 155, a 14 of diamonds 154, a 13 of diamonds 153, a 12 of diamonds 152, an 11 of diamonds 151, a 10 of diamonds, a 9 of diamonds, an 8 of diamonds, a 7 of diamonds, a 6 of diamonds, a 5 of diamonds, a 4 of diamonds, a 3 of diamonds, and a 1 of diamonds 157.

The cards contained within the suit of clubs 114 comprises a ace of clubs 264, a king of clubs 263, a queen of clubs 262, a jack of clubs 261, a 16 of clubs 166, a 15 of clubs 165, a 14 of clubs 164, a 13 of clubs 163, a 12 of clubs 162, an 11 of clubs 161, a 10 of clubs, a 9 of clubs, an 8 of clubs, a 7 of clubs, a 6 of clubs, a 5 of clubs, a 4 of clubs, a 3 of clubs, a 2 of clubs, and a 1 of clubs 167.

The order of rank from highest to lowest of the cards contained in the suit of spades 111 is the joker ace 134, the joker king 133, the joker queen 132, the joker jack 131, the 16 of spades 126, the 15 of spades 125, the 14 of spades 124, the 13 of spades 123, the 12 of spades 122, the 11 of spades 121, the 10 of spades, the 9 of spades, the 8 of spades, the 7 of spades, the 6 of spades, the 5 of spades, the 4 of spades, the 3 of spades, the 2 of spades, and the 1 of spades 127.

The order of rank from highest to lowest of the cards contained in the suit of hearts 112 is the ace of hearts 244, the king of hearts 243, the queen of hearts 242, the jack of hearts 241, the 16 of hearts 146, the 15 of hearts 145, the 14 of hearts 144, the 13 of hearts 143, the 12 of hearts 142, the 11 of hearts 141, the 10 of hearts, the 9 of hearts, the 8 of hearts, the 7 of hearts, the 6 of hearts, the 5 of hearts, the 4 of hearts, the 3 of hearts, and the 1 of hearts 147.

The order of rank from highest to lowest of the cards contained in the suit of diamonds 113 is the ace of diamonds 254, the king of diamonds 253, the queen of diamonds 252, the jack of diamonds 251, the 16 of diamonds 156, the 15 of diamonds 155, the 14 of diamonds 154, the 13 of diamonds 153, the 12 of diamonds 152, the 11 of diamonds 151, the 10 of diamonds, the 9 of diamonds, the 8 of diamonds, the 7 of diamonds, the 6 of diamonds, the 5 of diamonds, the 4 of diamonds, the 3 of diamonds, and the 1 of diamonds 157.

The order of rank from highest to lowest of the cards contained in the suit of clubs 114 is the ace of clubs 264, the king of clubs 263, the queen of clubs 262, the jack of clubs 261, the 16 of clubs 166, the 15 of clubs 165, the 14 of clubs 164, the 13 of clubs 163, the 12 of clubs 162, the 11 of clubs 161, the 10 of clubs, the 9 of clubs, the 8 of clubs, the 7 of clubs, the 6 of clubs, the 5 of clubs, the 4 of clubs, the 3 of clubs, the 2 of clubs, and the 1 of clubs 167.

To play a hand of the invention 100, the full 78 card deck 101 is dealt to the six players such that each player has the same number of cards. This provides for 13 tricks in each hand of play. As discussed in more detail elsewhere in this disclosure, the suit of spades 111 is the trump suit. The order of play for each trick is a follows.

A lead player is selected from the group consisting of: 1) the player to the left of the (sixth) player who dealt the 78 card deck 101, and, 2) the player who won the previous trick. The lead player presents a card face up to start the trick.

The second player to play sits to the left of the lead player. The second player presents a card face up for their turn. The second player is constrained to play a card from the same suit as played by the lead player if the second player has such a card. If the second player does not have such a card, the second player may play any card from the cards the second player has.

The third player to play sits to the left of the second player. The third player presents a card face up for their turn. The third player is constrained to play a card from the same suit as played by the lead player if the third player has such a card. If the third player does not have such a card, the third player may play any card from the cards the third player has.

The fourth player to play sits to the left of the third player. The fourth player presents a card face up for their turn. The fourth player is constrained to play a card from the same suit as played by the lead player if the fourth player has such a card. If the fourth player does not have such a card, the fourth player may play any card from the cards the fourth player has.

The fifth player to play sits to the left of the fourth player. The fifth player presents a card face up for their turn. The fifth player is constrained to play a card from the same suit as played by the lead player if the fifth player has such a card. If the fifth player does not have such a card, the fifth player may play any card from the cards the fifth player has.

The sixth player to play sits to the left of the fifth player. The sixth player presents a card face up for their turn. The sixth player is constrained to play a card from the same suit as played by the lead player if the sixth player has such a card. If the sixth player does not have such a card, the sixth player may play any card from the cards the sixth player has.

Once all players have presented a card, the trick is awarded to a player on the following basis: 1) if no trump card has been presented, the player presenting the highest ranked card of the suit played by the lead player wins the trick (this player may be the lead player); 2) if a single trump card has been presented, the player who presented the trump card wins the trick; or 3) if multiple trump cards have been presented, the player who presented the highest ranked card of the trump suit wins the trick.

The winner of the trick is then selected as the new lead player and the next trick is initiated until all cards from the 78 card deck 101 have been played. At that point, the lead player of the first trick of the current hand becomes the sixth player of the first trick of the subsequent hand.

The invention 100 is a cumulative scoring game that is played in a partnership format. Three partnerships of two players compete against each other for scoring purposes. At the beginning of the game, each player declares the number of tricks the individual player will take. The number from each partner is added to set a goal for the number of tricks to be reached by each partnership. Should a partnership reach their goal, the partnership is awarded points to add to their cumulative goal. The number of points added is a function of the number of total tricks bid and the number total tricks won. Should a partnership fail to reach their goal, the partnership is forfeits points from their cumulative goal. The number of points forfeited is a function of the number of total tricks bid and the number total tricks won. A partnership is declared the winning partnership once their cumulative score exceeds a previously determined threshold.

The following definitions were used in this disclosure:

Card: As used in this disclosure, a card means a flat stiff piece of material that bears information. Typical materials used to make cards include, but are not limited to, heavy paper, cardboard, plastic coated paper, or thin plastic. While this disclosure allows for variations in the size of a card, it is anticipated that cards will approximate the size of a traditional deck of playing cards. The side of a card that bears the information is called the face. The reverse side from the face of the card is called the back. In an honest deck, the back of each card is identical.

Claim: As used within the background and specification of this disclosure, to claim is used as a verb meaning to win a trick. When used as a noun, claim refers to one or more of the claims presented within this disclosure.

Deal: As used in this disclosure, a deal refers to the distribution of playing cards to players for the initiation of a hand.

Deck: As used in this disclosure, a deck refers to a set of playing cards that contains all cards necessary for playing a previously determined game of cards. A traditional deck contains 52 cards. The use of traditional decks are well known and documented.

Face Card: As used in this disclosure, a face card refers to a card with a rank that is not presented on the face as a number.

Face Up: As used in this disclosure, face up refers to the presentation of a card in a manner that is visible to all the players.

Hand: As used in this disclosure, a hand refers to the play of a card game commencing with the dealing of a deck and ending with the subsequent dealing of a deck to start the next hand.

Joker: As used in this disclosure, a joker refers to one or more additional cards that are included in a deck of playing cards for the purpose of replacing lost cards. In many card games, the jokers are incorporated in the game to act as a wild card or a trump card with the highest order of rank.

Order: As used in this disclosure, an order refers to the specific card valuations that form the rank of a suit as well as the card valuations imposed by each suit. An order assigns relative valuations to each card in a deck.

Plain Suit: As used in this disclosure, a plain suit refers to a suit that is not trump.

Rank: As used in this disclosure, rank refers to the value of the face of a card within a suit. Rank is used to determine the relative value of each card within the suit. The order of rank can vary with the card game being played.

Suit: As used in this disclosure, a suit refers to a symbol that is printed on the face of a card that is used to organize the cards contained within a deck into a subset of playing cards. In a traditional deck of playing cards, the suits are commonly called clubs, diamonds, hearts, and spades. Depending on the card game, the value or importance of the suits may be ordered or ranked for playing purposes.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Trick Taking Game: As used in this disclosure, a trick taking game refers to a point based game of cards comprising three or more players. A trick taking game comprises multiple rounds wherein each round is called a trick. Within each trick, each player plays a single card. After all players have played their card, a single player is awarded the trick based on the rank, and suit of the winning player's card relative to the other cards that were played in the trick. In a plain trick game, the value of the trick is independent on the rank or suit of the cards that were played. In a point trick game, the value of the trick is dependent on the rank or suit of the cards that were played.

Trump: As used in this disclosure, a trump refers to a suit within a deck of cards that has been previously determined to outrank all other cards during the play of a trick. Generally, a trump will not change during a hand. When multiple trump cards are played in a trick, the order of rank determines the winner of the trick.

Wild Card: As used in this disclosure, a wild card refers to a card that is designated as being able to substitute for any other card contained within the deck of cards.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A competitive game comprising:

a deck of 78 playing cards;

wherein the deck of 78 playing cards is a customized deck of playing cards;

wherein the deck of 78 playing cards is referred to as the 78 card deck;

wherein the 78 card deck comprises a plurality of suits;

wherein each card contained within the 78 card deck is assigned to a suit;

wherein the number of cards contained within each suit varies by suit;

wherein each card contained within the 78 card deck is assigned to a suit selected from the group consisting of a spade suit, a heart suit, a diamond suit, and a club suit;

wherein each card selected from the 78 card deck is only assigned to one suit;

wherein there are 20 cards selected from the 78 card deck assigned to the spade suit comprising a joker ace, a joker king, a joker queen, a joker jack, a 16 of spades, a 15 of spades, a 14 of spades, a 13 of spades, a 12 of spades, an 11 of spades, a 10 of spades, a nine of spades, an 8 of spades, a 7 of spades, a 6 of spades, a 5 of spades, a 4 of spades, a 3 of spades, a 2 of spades, and a 1 of spades;

wherein there are 19 cards selected from the 78 card deck assigned to the heart suit comprising an ace of hearts, a king of hearts, a queen of hearts, a jack of hearts, a 16 of hearts, a 15 of hearts, a 14 of hearts, a 13 of hearts, a 12 of hearts, an 11 of hearts, a 10 of hearts, a 9 of hearts, an 8 of hearts, a 7 of hearts, a 6 of hearts, a 5 of hearts, a 4 of hearts, a 3 of hearts, and a 1 of hearts;

wherein there are 19 cards selected from the 78 card deck assigned to the diamond suit comprising an ace of diamonds, a king of diamonds, a queen of diamonds, a jack of diamonds, a 16 of diamonds, a 15 of diamonds, a 14 of diamonds, a 13 of diamonds, a 12 of diamonds, an 11 of diamonds, a 10 of diamonds, a 9 of diamonds, an 8 of diamonds, a 7 of diamonds, a 6 of diamonds, a 5 of diamonds, a 4 of diamonds, a 3 of diamonds, and a 1 of diamonds;

wherein there are 20 cards selected from the 78 card deck assigned to the club suit comprising an ace of clubs, a king of clubs, a queen of clubs, a jack of clubs, a 16 of clubs, a 15 of clubs, a 14 of clubs, a 13 of clubs, a 12 of clubs, an 11 of clubs, a 10 of clubs, a 9 of clubs, an 8 of clubs, a 7 of clubs, a 6 of clubs, a 5 of clubs, a 4 of clubs, a 3 of clubs, a 2 of clubs and a 1 of clubs;

wherein the competitive game is a plain trick card game;

wherein the competitive game is played with six players;

wherein each of the cards contained in the 78 card deck is dealt to the six players;

wherein the activities between each dealing of the 78 card deck to the six players is called a hand;

wherein a hand of the competitive game has 13 tricks;

wherein each suit is further defined with an order or rank;

wherein the play of a trick comprises the following steps;

wherein a lead player is selected from the group consisting of: 1) the player to the left of the player who dealt the 78 card deck of the current hand, and, 2) the player who won the previous trick;

wherein the lead player presents a first played card face up to start the trick;

wherein the second player to play sits to the left of the lead player;

wherein the second player presents a second played card face up for their turn;

wherein the second player is constrained to play the second played card such that the second played card is from the same suit as played by the lead player if the second player has such a card;

wherein if the second player does not have such a card, the second player may play any card from the cards the second player has as the second played card;

wherein the third player to play sits to the left of the second player;

wherein the third player presents a third played card face up for their turn;

wherein the third player is constrained to play the third played card such that third played card is from the same suit as played by the lead player if the third player has such a card;

wherein if the third player does not have such a card, the third player may play any card from the cards the third player has as the third played card;

wherein the fourth player to play sits to the left of the third player;

wherein the fourth player presents a fourth played card face up for their turn;

wherein the fourth player is constrained to play the fourth played card such that the fourth played card is from the same suit as played by the lead player if the fourth player has such a card;

wherein if the fourth player does not have such a card, the fourth player may play any card from the cards the fourth player has as the fourth played card;

wherein the fifth player to play sits to the left of the fourth player;

wherein the fifth player presents a fifth played card face up for their turn;

wherein the fifth player is constrained to play the fourth played card such that the fourth played card is from the same suit as played by the lead player if the fifth player has such a card;

wherein if the fifth player does not have such a card, the fifth player may play any card from the cards the fifth player has as the fifth played card;

wherein the sixth player to play sits to the left of the fifth player;

wherein the sixth player presents a card face up for their turn;

wherein the sixth player is constrained to play the sixth played card such that the sixth played card is from the same suit as played by the lead player if the sixth player has such a card;

wherein if the sixth player does not have such a card, the sixth player may play any card from the cards the sixth player has the sixth played card.

2. The competitive game according to claim 1 wherein each card contained within the 78 card deck has a unique image printed on the face of the card.

3. The competitive game according to claim 1 wherein the order of rank from highest to lowest of the cards contained in the suit of spades is the joker ace, the joker king, the joker queen, the joker jack, the 16 of spades, the 15 of spades, the 14 of spades, the 13 of spades, the 12 of spades, the 11 of spades, the 10 of spades, the 9 of spades, the 8 of spades, the 7 of spades, the 6 of spades, the 5 of spades, the 4 of spades, the 3 of spades, the 2 of spades, and the 1 of spades.

4. The competitive game according to claim 1 wherein the order of rank from highest to lowest of the cards contained in the suit of hearts is the ace of hearts, the king of hearts, the queen of hearts, the jack of hearts, the 16 of hearts, the 15 of hearts, the 14 of hearts, the 13 of hearts, the 12 of hearts, the 11 of hearts, the 10 of hearts, the 9 of hearts, the 8 of hearts, the 7 of hearts, the 6 of hearts, the 5 of hearts, the 4 of hearts, the 3 of hearts, and the 1 of hearts.

5. The competitive game according to claim 1 wherein the order of rank from highest to lowest of the cards contained in the suit of diamonds is the ace of diamonds, the king of diamonds, the queen of diamonds, the jack of diamonds, the 16 of diamonds, the 15 of diamonds, the 14 of diamonds, the 13 of diamonds, the 12 of diamonds, the 11 of diamonds, the 10 of diamonds, the 9 of diamonds, the 8 of diamonds, the 7 of diamonds, the 6 of diamonds, the 5 of diamonds, the 4 of diamonds, the 3 of diamonds, and the 1 of diamonds.

6. The competitive game according to claim 1 wherein the order of rank from highest to lowest of the cards contained in the suit of clubs is the ace of clubs, the king of clubs, the queen of clubs, the jack of clubs, the 16 of clubs, the 15 of clubs, the 14 of clubs, the 13 of clubs, the 12 of clubs, the 11 of clubs, the 10 of clubs, the 9 of clubs, the 8 of clubs, the 7 of clubs, the 6 of clubs, the 5 of clubs, the 4 of clubs, the 3 of clubs, the 2 of clubs, and the 1 of clubs.

7. The competitive game according to claim 1 wherein the full 78 card deck is dealt to the six players such that each player has the same number of cards.

8. The competitive game according to claim 1 wherein the suit of spades is a trump suit.

9. The competitive game according to claim 1 wherein if no trump card has been presented during trick play the player presenting the highest ranked card of the suit played by the lead player wins the trick wherein if a single trump card has been presented during trick play the player who presented the trump card wins the trick;

wherein if multiple trump cards have been presented during trick play the player who presented the highest ranked card of the trump suit wins the trick;

wherein the winner of the trick is then selected as the new lead player and the next trick is initiated until all cards from the 78 card deck have been played;

wherein once all cards from the 78 have been played the lead player of the first trick of the current hand becomes the sixth player of the first trick of the subsequent hand.

10. The competitive game according to claim 1 wherein the competitive game is a cumulative scoring game;

wherein the competitive game is played in a partnership format;

wherein three partnerships of two players compete against each other for scoring purposes;

wherein before commencement of a trick play of a hand each player declares the number of tricks the individual player will take;

wherein the number from each partner is added to set a goal for the number of tricks to be reached by each partnership;

wherein should a partnership reach their goal, the partnership is awarded points to add to their cumulative goal;

wherein the number of points added is a function of the number of total tricks bid and the number total tricks won;

wherein should a partnership fail to reach their goal, the partnership is forfeits points from their cumulative goal;

wherein the number of points forfeited is a function of the number of total tricks bid and the number total tricks won;

wherein a partnership is declared the winning partnership once their cumulative score exceeds a previously determined threshold.

* * * * *